US008944218B2

(12) United States Patent
Peschel et al.

(10) Patent No.: US 8,944,218 B2
(45) Date of Patent: Feb. 3, 2015

(54) PALLET FORK

(75) Inventors: Daniel E. Peschel, Manhattan, KS (US); Andrew L. Vering, Manhattan, KS (US); Jimmy L. Stewart, Manhattan, KS (US); Ryan P. Shea, Manhattan, KS (US)

(73) Assignee: Caterpillar Inc., Peoria, IL (US)

( * ) Notice: Subject to any disclaimer, the term of this patent is extended or adjusted under 35 U.S.C. 154(b) by 491 days.

(21) Appl. No.: 13/274,672

(22) Filed: Oct. 17, 2011

(65) Prior Publication Data

US 2013/0092478 A1 Apr. 18, 2013

(51) Int. Cl.
*B66F 9/14* (2006.01)

(52) U.S. Cl.
CPC ..... *B66F 9/144* (2013.01)
USPC ..... 187/237

(58) Field of Classification Search
CPC ..... B66B 9/14
USPC ..... 187/237; 414/607, 667, 671
See application file for complete search history.

(56) References Cited

U.S. PATENT DOCUMENTS

| | | | | | |
|---|---|---|---|---|---|
| 3,734,327 | A | * | 5/1973 | Ellis, Jr. | 414/667 |
| 3,851,779 | A | * | 12/1974 | Crawford | 414/667 |
| 4,498,838 | A | * | 2/1985 | Johannson | 414/664 |
| 4,850,789 | A | | 7/1989 | Zimmerman | |
| 4,963,071 | A | | 10/1990 | Larwin | |
| 5,314,292 | A | | 5/1994 | Holopainen | |
| 5,639,205 | A | | 6/1997 | Kaczmarczyk | |
| 6,056,503 | A | * | 5/2000 | Way et al. | 414/722 |
| 6,168,369 | B1 | | 1/2001 | Bright | |
| 6,990,838 | B2 | | 1/2006 | Witchey | |
| 2004/0086366 | A1 | * | 5/2004 | Henning | 414/667 |
| 2010/0101895 | A1 | * | 4/2010 | Collins et al. | 187/237 |

FOREIGN PATENT DOCUMENTS

| | | |
|---|---|---|
| EP | 1586708 | 7/2008 |
| JP | 06009197 | 1/1994 |
| JP | 06056397 | 3/1994 |
| JP | 2010150014 | 7/2010 |
| KR | 2019850005955 | 8/1985 |

* cited by examiner

*Primary Examiner* — William E Dondero
*Assistant Examiner* — Diem Tran
(74) *Attorney, Agent, or Firm* — Miller, Matthias & Hull; Bart A. Fisher

(57) ABSTRACT

A pallet fork includes a frame having a top support tube and a bottom support tube between opposing end plates. A fork bar and a carriage plate are supported by the frame. A fork tine is mounted to the fork bar via a slotted tube. The fork tine includes a vertical leg and a horizontal leg. The slotted tube is at an upper portion of the vertical leg. A locking plate is provided on the top support tube. An upper locking member selectively inserted through a slot in the slotted tube and through one of a plurality of notches to engage the vertical leg of the fork tine with the locking plate and restrict lateral motion of the fork tine. The upper locking member has a head portion with an open point that rests on a top surface of the top support tube.

20 Claims, 5 Drawing Sheets

PALLET FORK

TECHNICAL FIELD

The present disclosure relates to an implement for lifting a load. In a specific embodiment the present disclosure relates to a pallet fork for a loader, tractor, or other machine.

BACKGROUND

Implements for lifting a load are widely used on machines. For example, buckets, forks, and other lifting implements are often coupled to lift arms of a forklift, a wheel loader, a track loader, a tractor, and/or other types of machines.

United States Patent Application Publication Number 2010/0101895 relates to a pallet fork including a structural frame, a fork bar, a swing bar, and a pair of fork tines. The swing bar may be selectively inserted through a pair of locks, provided in the fork tines, to fix and restrict a swingable motion of the fork tines. Further, the swing bar can be conveniently stored onboard the pallet fork when it is inoperative.

While the related art provides suitable lifting devices, there is still room for improvement on such devices. Thus, the present disclosure provides an improved pallet fork.

SUMMARY OF THE DISCLOSURE

In one aspect, the present disclosure provides a pallet fork with a frame having a top support tube and a bottom support tube between opposing end plates. A fork bar and a carriage plate are supported by the frame and extend in a longitudinal direction of the pallet fork. A fork tine is mounted to the fork bar via a slotted tube. The fork tine has a pivotable motion and a lateral motion relative thereto. The fork tine includes a vertical leg and a horizontal leg. The slotted tube is at an upper portion of the vertical leg. A locking plate having a plurality of notches is provided on the top support tube. An upper locking member is configured to be selectively inserted through a slot in the slotted tube and through one of the plurality of notches to engage the vertical leg of the fork tine with the locking plate and restrict the lateral motion of the fork tine. The upper locking member has a head portion with an open point that rests on a top surface of the top support tube.

In another aspect, the disclosure provides removable pallet fork having a frame with a top support tube and a bottom support tube between opposing end plates. A fork bar and a carriage plate are supported by the frame and extend in a longitudinal direction of the pallet fork. A fork tine is mounted to the fork bar via a slotted tube. The fork tine has a pivotable motion and a lateral motion relative to the slotted tube. The fork tine includes a vertical leg and a horizontal leg. The slotted tube is welded to an upper portion of the vertical leg. A locking plate is on the top support tube and includes a notch. An upper locking member is configured to be selectively inserted through a slot in the slotted tube and through the notch to engage the vertical leg of the fork tine with the locking plate and restrict the lateral motion of the fork tine. The upper locking member has a head portion with an open point that rests on a top surface of the top support tube. The upper locking member also has a shoulder. The pivotable motion being limited by the shoulder contacting an end point of the slot. A first set of ribs extend between the top support tube and the bottom support tube. The first set of ribs being oriented with an inward slant towards a rear portion of the of pallet fork. A second set of ribs extend between the top support tube and the bottom support tube and are inward of the first set of ribs. The second set of ribs are oriented substantially normal to a longitudinal direction of the removable pallet fork. One or more mounting brackets are located on the frame and are configured to removably mate with a machine.

Other features, aspects, and advantages of this disclosure will be apparent from the following description and the accompanying drawings.

DETAILED DESCRIPTION

Figure 1:
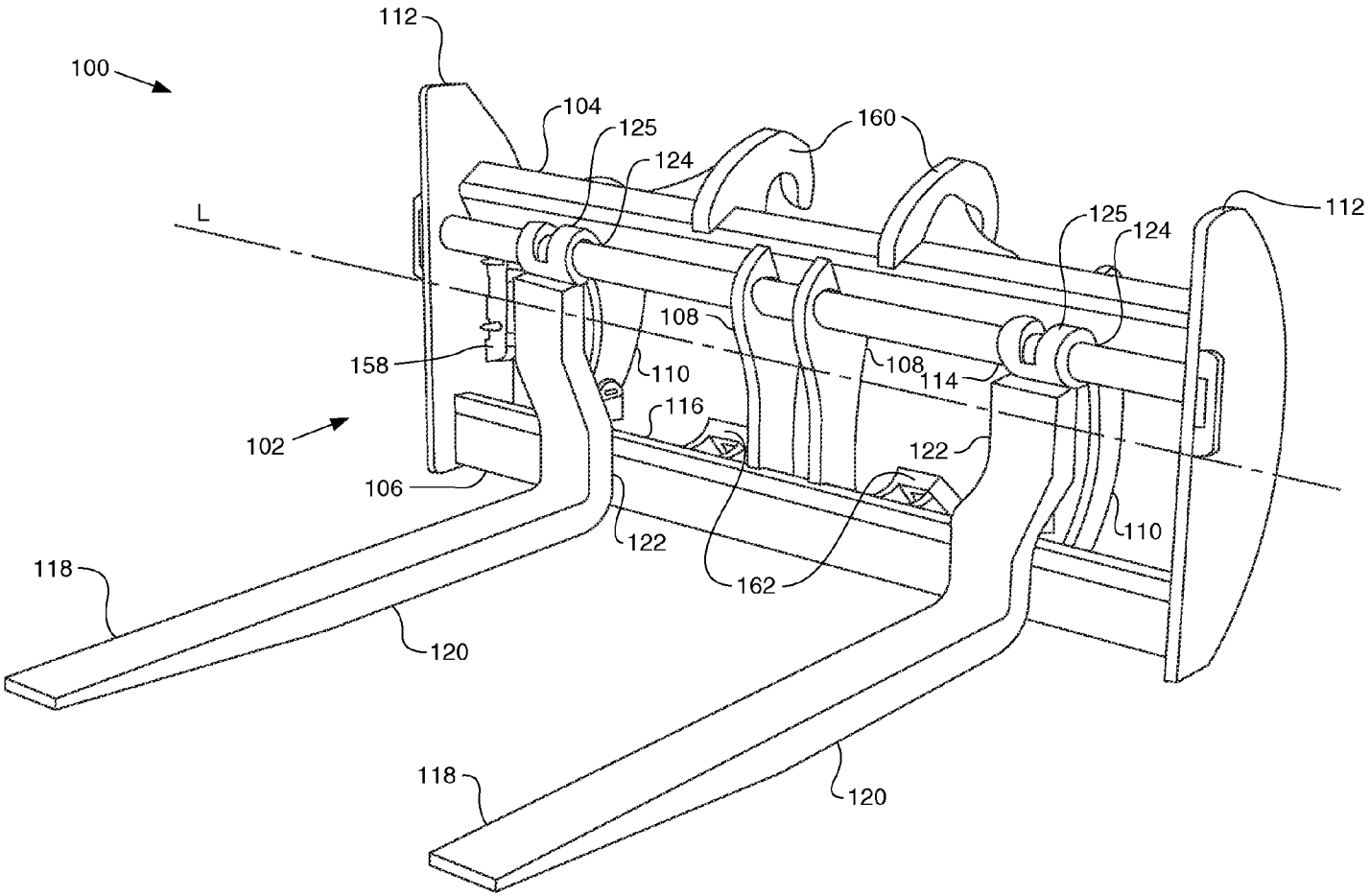
FIG. 1 illustrates a perspective view of a pallet fork according to an embodiment of the present disclosure.

FIGS. 1-6 illustrate various views of a pallet fork 100 according to an embodiment of the present disclosure. The pallet fork 100 includes a frame 102. The frame 102 may take many different forms as will be recognized by those of ordinary skill in this art. In the illustrated embodiment the frame 102 includes a top support tube 104 and a bottom support tube 106. The top support tube 104 and the bottom support tube 106 may form individual structural members of the pallet fork 100 and may be disposed approximately parallel to one another. As shown, top support tube 104 has a square cross sectional shape and bottom support tube 106 has a rectangular cross sectional shape. However, it should be understood that support tubes 104 and 106 may have other cross-sectional shapes. The components of the pallet fork 100 are generally formed of iron, steel or other material, which may be hardened, annealed, or otherwise heat-treated.

The top support tube 104 and bottom support tube 106 may be secured together by sets of ribs, such as a set of inner ribs 108 and a set of outer ribs 110. The inner ribs 108 are the vertically oriented plates near a center point or a midplane of the top support tube 104 and the bottom support tube 106. The inner ribs 108 are structurally joined to the top support tube 104 and the bottom support tube 106 by welding, brazing, or any other practical means. In an embodiment, the inner ribs 108 are oriented with an outward slant towards a rear portion of the of pallet fork 100 such that a user operating a machine (not shown) coupled to the pallet fork 100 can view from an operator's station on the machine through the inner ribs 108 substantially without visual obstruction from the inner ribs 108. In other words, the user would substantially only see rear edge portions of the inner ribs 108 when viewing from the operator's station (See also FIG. 4).

However, in another alternative embodiment, the inner ribs 108 may be approximately parallel to one another, and approximately normal to the top support tube 104 and the bottom support tube 106 (e.g., substantially normal to a longitudinal direction L of the pallet fork 100). The inner ribs 108 are two separate plate-like members in the illustrated embodiment, however may be formed as a single plate or other element, or more than two plates, based on the design of the pallet fork 100.

The outer ribs 110 are the vertically oriented plates close to the distal ends of the top support tube 104 and the bottom support tube 106. The outer ribs 110 are also structurally joined to the top support tube 104 and the bottom support tube 106 by welding, brazing, or any other practical means. In an embodiment, the outer ribs 110 are oriented with an inward slant towards a rear portion of the of pallet fork 100 such that the user operating the machine coupled to the pallet fork 100 can view from an operator's station on the machine through the outer ribs 110 substantially without visual obstruction from the outer ribs 110. In other words, the user would substantially only see rear edge portions of the outer ribs 110 when viewing from the operator's station (See also FIG. 4).

However, in another alternative embodiment, the outer ribs 110 may be approximately parallel to one another. The outer ribs 110 may also be approximately normal to the top support tube 104 and the bottom support tube 106. The outer ribs 110 are two separate plate-like members in the illustrated embodiment, however may be formed as more than two individual plates or other elements, based on the design of the pallet fork 100.

The distal ends of the top support tube 104 and the bottom support tube 106 are joined by a pair of end plates 112. The end plates 112 may be structurally joined to the top support tube 104 and the bottom support tube 106 by welding, brazing, riveting, or any other practical means. The end plates 112 may be vertically oriented plate-like members, and may be approximately parallel to one another and approximately normal to the top support tube 104 and the bottom support tube 106.

The frame 102 supports a fork bar 114 and a carriage plate 116. The fork bar 114 and the carriage plate 116 may extend in the longitudinal direction L of the pallet fork 100 and be supported by the end plates 112, the inner ribs 108, and the outer ribs 110. The end plates 112 and the inner ribs 108 may include substantially parallel and aligned bores for supporting the fork bar 114. Further, the fork bar 114 may be bolted, welded, or otherwise coupled to the end plates 112 to keep the fork bar 114 from retracting out of the bores. In an embodiment, the fork bar 114 is formed of a solid steel bar having a circular cross-sectional shape.

In an embodiment, the pallet fork 100 may include a single fork bar 114 spanning between the end plates 112, or alternatively the fork bar 114 may be divided into two separate bars which may be joined, such as, at a laterally central location of the pallet fork 100. Dividing the fork bar 114 into two separate smaller bars facilitates assembling and disassembling as each bar will be shorter and weigh less.

In an embodiment, the carriage plate 116 may be structurally joined to the bottom support tube 106 by welding, brazing, bolts, screws, rivets, or any other practical means. In another embodiment, the carriage plate 116 may be formed integrally with the bottom support tube 106. However, in yet another embodiment, the carriage plate 116 may be provided anywhere between the top support tube 104 and the bottom support tube 106 and be supported by the end plates 112, the inner ribs 108, and the outer ribs 110.

Fork tines 118 are mounted to the fork bar 114 via a tube 125. The fork tines 118 include a horizontal leg 120 and a vertical leg 122 which may be approximately normal to one another. A bore 124 is formed through tube 125. Tube 125 is attached to an upper portion of vertical leg 122 of each of the fork tines 118 by welding, brazing, riveting, or any other practical means. In an embodiment, tube 125 extends substantially along a width of vertical leg 122. In another embodiment, tube 125 may be integrally formed in vertical leg 122 of each fork tine 118. Accordingly, the bore 124 is substantially circular and configured to receive and mate with the fork bar 114. Each of the fork tines 118 may rotate about the fork bar 114 at the bore 124. Further, each of fork tines 118 may also have lateral movement along the fork bar 114 in the longitudinal direction L.

Figure 2:
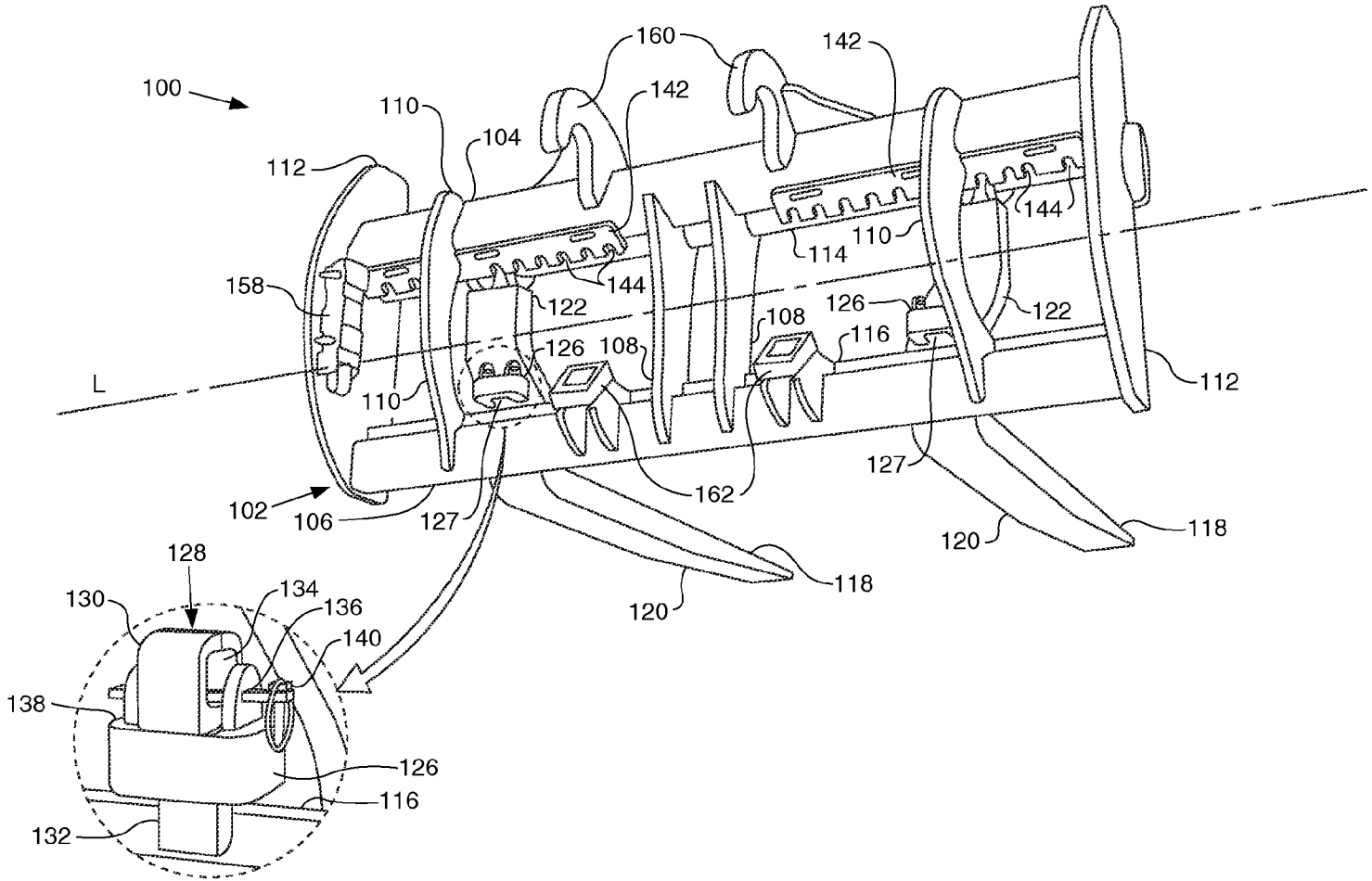
FIG. 2 illustrates a perspective view of the pallet fork of FIG. 1 and an embodiment of a lower locking member.

As illustrated in FIG. 2, a bracket 126 is attached to a rear portion of the vertical leg 122 of each of the fork tines 118. The bracket 126 is disposed in the proximity of the carriage plate 116 and joined to the vertical leg 122 of the fork tine 118 by welding, brazing, riveting or any other practical means. Further, the bracket 126 has an opening 127, substantially normal to the longitudinal direction L, such that a lower locking member 128 may be selectively inserted in the opening 127 of the bracket 126.

In an embodiment, the lower locking member 128 may include a head portion 130 and a shaft portion 132. The shaft portion 132 of the lower locking member 128 is configured to be partially received in the opening 127 of the bracket 126 and partially adjoined to the carriage plate 116. Further, the head portion 130 of the lower locking member 128 may have a through-hole 134, which is substantially aligned to a pair of apertures 136 provided on the bracket 126.

In an embodiment, a first pin 138 is configured to be selectively inserted in the through-hole 134 of the lower locking member 128, and the apertures 136 of the bracket 126, to hold the lower locking member 128 in the bracket 126. The first pin 138 may be a pull lock pin, such as a lynch pin, with a ring grip 140. In various other embodiments, the lower locking member 128 may have different shape, for example, but not limited to, a looped shape, a folded/clamp shape, or any other practical shape. Moreover, the lower locking member 128 may use a bolt and nut assembly to hold the lower locking member 128 in the bracket 126.

In one embodiment, a locking plate 142 is provided on the top support tube 104 of the frame 102. The locking plate 142 may have one or more notches 144 used for locating fork tines 118 along longitudinal direction L of the pallet fork 100.

Figure 3:
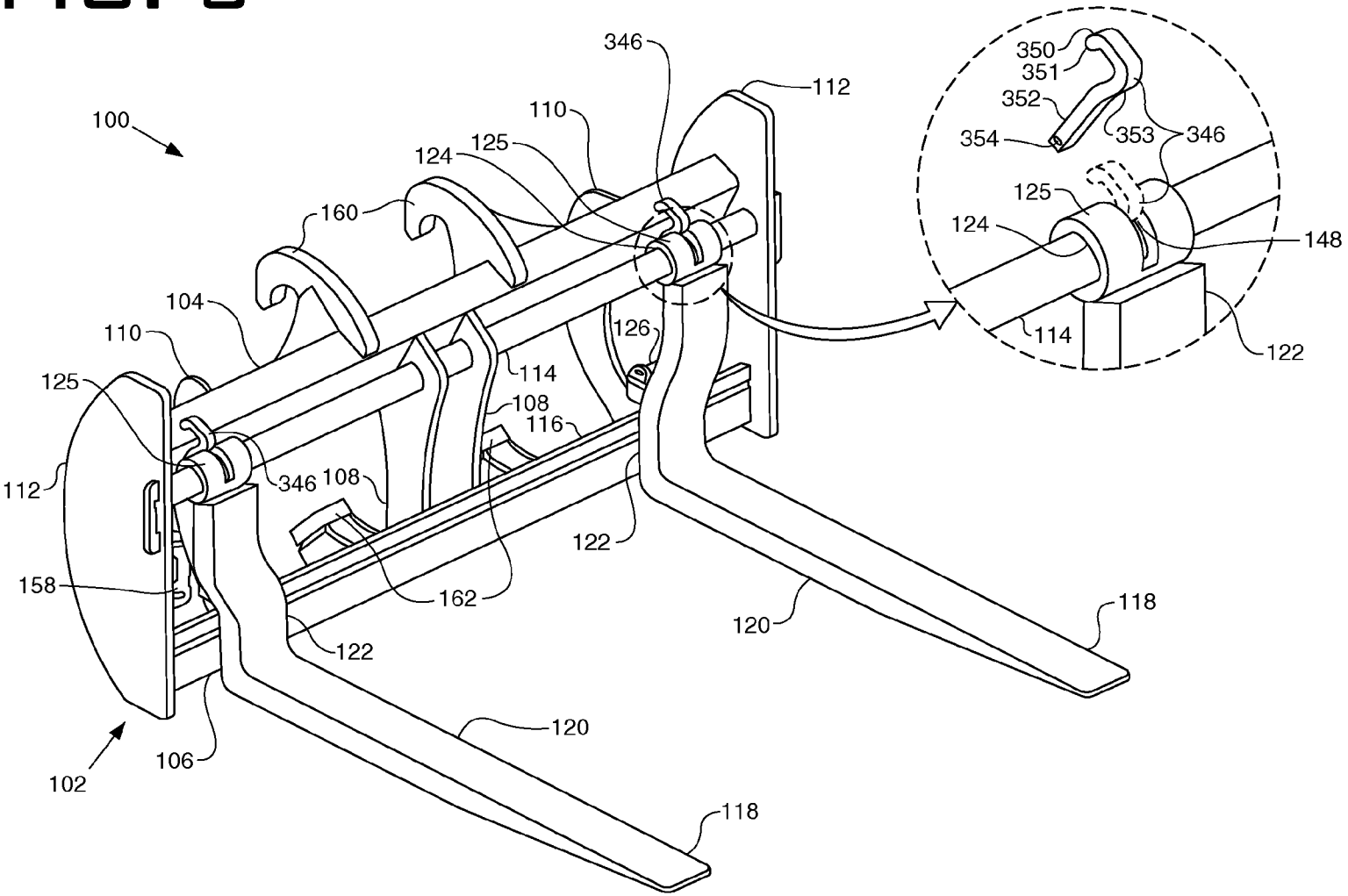
FIG. 3 illustrates another perspective view of the pallet fork of FIG. 1 and an embodiment of an upper locking member.

As illustrated in FIG. 3, an upper locking member 346 is configured to be selectively inserted through a slot 148 in tube 125 provided on the vertical leg 122 of the fork tine 118. In an embodiment, the slot 148 is formed approximately one-half the distance through tube 125. The upper locking member 346 includes a head portion 350 and a shaft portion 352, thereby substantially forming a question mark ("?") shape. Further, the shaft portion 352 may include an aperture 354 through shaft portion 352. Upper locking member 346 is formed of iron, steel, or other suitable material. For example, in an embodiment, upper locking member 346 is formed of ASTM-572 steel by flame cutting a plate of the ASTM-572 steel. However, milling, casting, molding, extruding, or other forming process may form upper locking member 346.

Figure 4:
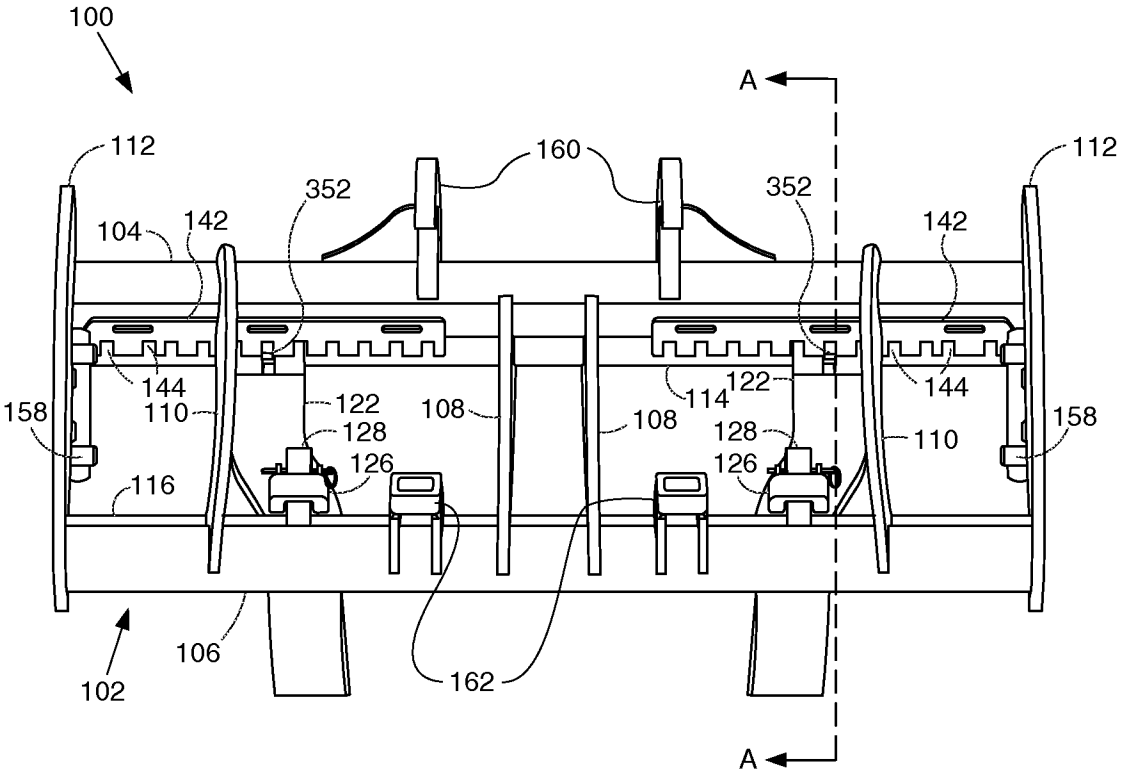
FIG. 4 illustrates a rear view of the pallet fork of FIG. 1 and the lower locking member of FIG. 2 and the upper locking member of FIG. 3.

As illustrated in FIG. 4, the shaft portion 352 of the upper locking member 346 may be selectively inserted through slot 148 and into one of a plurality of notches 144 of the locking plate 142. Inserting upper locking member 346 into different slots 148 allows the fork tines 118 to be located and held at different locations along fork bar 114.

Upper locking member 346 and slot 148 may be formed so that shaft portion 352 can only enter slot 148 at one orientation, such as where the open point 351 of the head portion 350 rests on top support tube 104 when upper locking member 346 is inserted. For example, shaft portion 352 and slot 148 may have a unique shape (e.g., mating wedge shape) or a specific dimension (e.g., larger dimension side to side than front to back or visa-versa). Additionally, if upper locking member 346 is inserted backwards (e.g., 180° from that shown in FIGS. 3, 5, and 6), a rear shoulder 353 of head portion 350 will interfere with top support tube 104 and thus, upper locking member 346 cannot be fully inserted in slot 148 with such orientation.

Figure 6:
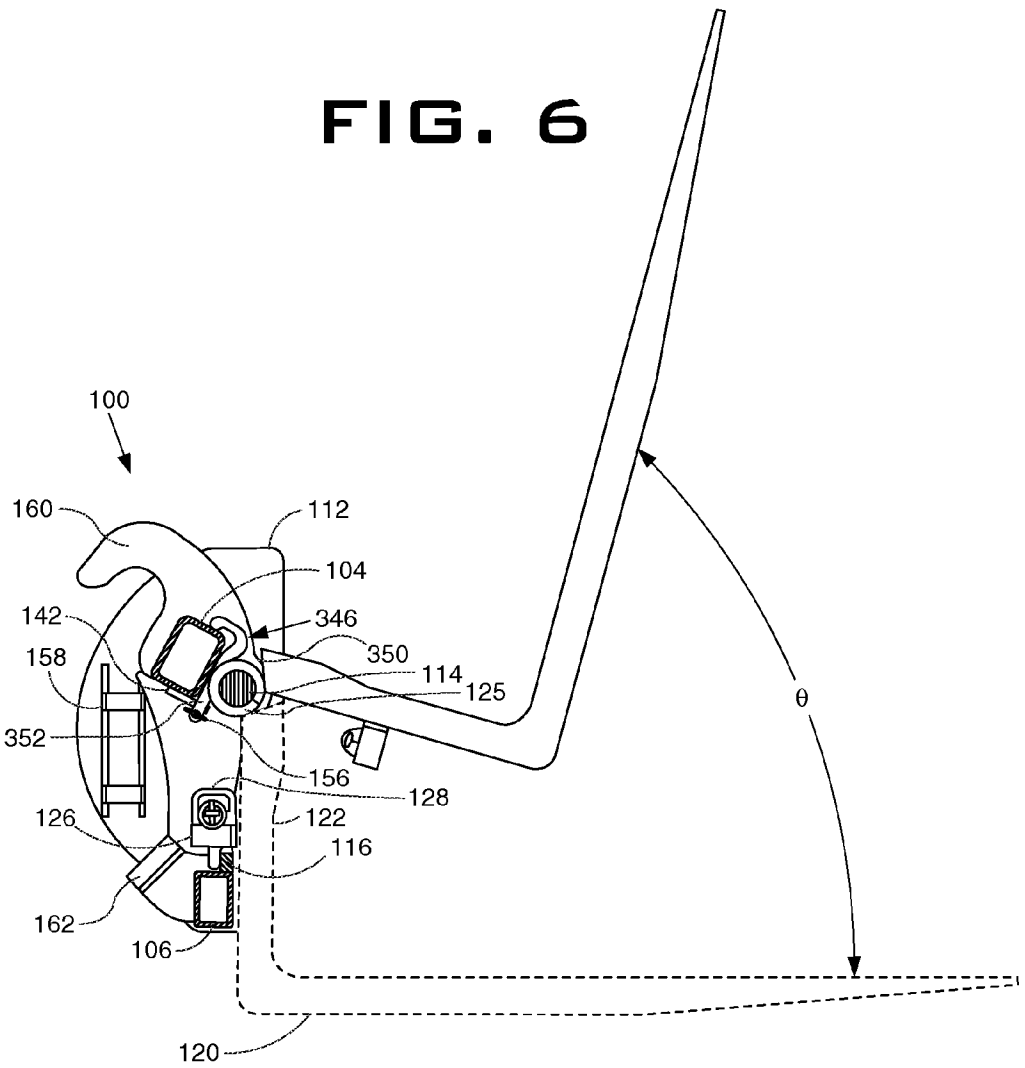
FIG. 6 illustrates a sectional view of the pallet fork of FIG. 4 along line A-A with the tines in a raised position.
Figure 5:
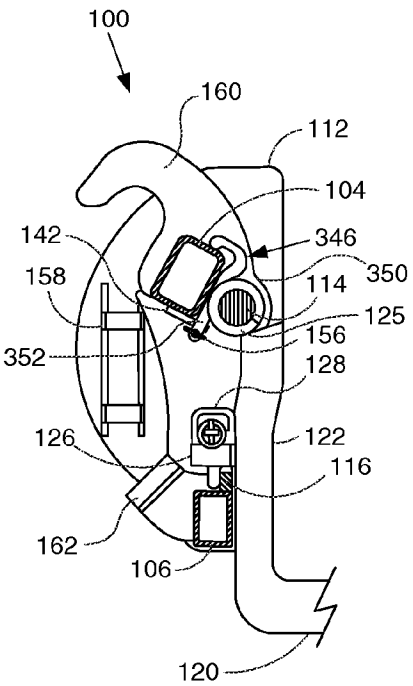
FIG. 5 illustrates a sectional view of the pallet fork of FIG. 4 along line A-A with the tines in a lowered position.

FIGS. 5 and 6 illustrate a sectional view of the pallet fork 100 along lines A-A of FIG. 4 where the fork tines 118 are lowered in FIG. 5 and rotated upward about fork bar 114 in FIG. 6. As illustrated, open point 351 of head portion 350 of the upper locking member 346 may be configured to rest on the top support tube 104. Further, a second pin 156 may be selectively inserted in the aperture 354 (see FIG. 3) of the upper locking member 346. The second pin 156 may be a pull lock pin, such as a lynch pin, selectively inserted in the aperture 354 to hold the upper locking member 346 in the notch 144 of the locking plate 142.

Accordingly, the length of the slot 148 allows the fork tines 118 to rotate upward an angle θ until the rear shoulder 353 of the head portion 350 contacts the tube 125 or the top of the vertical leg 122 of the fork tine 118. In an embodiment, the fork tine 118 can rotate upward angle θ a range of approximately 0° to approximately 75° from horizontal as shown in FIG. 6. In other words, in an embodiment, pivotable motion is restricted to a range of approximately 0° to approximately 75°. The upward motion is limited by the rear shoulder 353 portion of the upper locking member 346 contacting an end of the slot 148 in the slotted tube 125. As such, adjusting a depth of the slot 148 or adjusting the size/shape of the shoulder portion 353 adjusts the travel range of angle θ.

The pallet fork 100 may include a retainer 158 to store the lower locking member 128 and/or the upper locking member 346, when not in use. The retainer 158 may be mounted on the pair of end plates 112 by welding, brazing, riveting, or any other practical means.

The pallet fork 100 may include upper mounting brackets 160 and lower mounting brackets 162 for removably coupling the pallet fork 100 with lift arms on a machine, such as a wheel loader or other machine (not shown). The upper mounting brackets 160 may be welded, brazed, bolted, riveted, or otherwise attached to top support tube 104. The lower mounting brackets 162 may be welded, brazed, bolted, riveted, or otherwise attached to bottom support tube 106. As should be understood by those having ordinary skill in the art, the lift arms of the machine include a coupling system with pins, wedges, locks, and various other features that engage and lock with the upper mounting brackets 160 and the lower mounting brackets 162.

INDUSTRIAL APPLICABILITY

The pallet fork 100 may be used while coupled to a wheel loader, a track loader, a tractor, a forklift, or any other machine. The fork tines 118 can be fixed, or be allowed to swing about the fork bar 114 when the pallet fork 100 tilts forward. In addition, the fork tines 118 can be laterally moved along the fork bar 114 for customizing according to palletized loads. In an aspect, the lower and the upper locking members 128 and 346 may be selectively used to restrict the swingable and the lateral motion of the fork tines 118, respectively.

As described herein, the disclosure provides a quick and retrofittable system of restricting the swingable motion of the fork tine 118 relative to the frame 102 of the pallet fork 100. The fork tine 118 may be mounted to the fork bar 114. As described earlier, the bore 124 provided on the vertical leg 122 of the fork tine 118 may receive the fork bar 114.

Subsequently, the vertical leg 122 of the fork tine 118 may be aligned with the carriage plate 116, which is connected to the bottom support tube 106 of the frame 102 of the pallet fork 100. The alignment may be achieved by moving the fork tine 118 to bring the vertical leg 122 of the fork tine 118 in contact with the bottom support tube 106 of the frame 102.

Then, the lower locking member 128 may be selectively inserted in the bracket 126 provided on the vertical leg 122 of the fork tine 118, to engage the fork tine 118 with the carriage plate 116 of the frame 102. The swingable motion of the fork tine 118 relative to the fork bar 114 supported on the frame 102 may be restricted by lower locking member 128.

The lower locking member 128 described above is a locking device including the head portion 130 and the shaft portion 132. Moreover, the lower locking member 128 may be fixed or removed from the bracket 126 without any tools. Additionally, the lower locking member 128 may not hamper visibility of an operator through the frame 102 to the ends of the fork tines 118 and also to the load to be picked-up. In an embodiment, as illustrated in FIG. 5, the top support tube 104 may be angled with respect to the bottom support tube 106 to further improve the visibility of the operator.

In yet another embodiment, the "?" shaped upper locking member 346 may be inserted in the notch 144 of the locking plate 142 supported on the frame 102, as described above. The upper locking member 346 may assist in restricting the lateral motion of the fork tine 118 relative to the fork bar 114. Moreover, the upper locking member 346 may be held in the notch 144 by selectively inserting the second pin 156 in the upper locking member 346. Additionally, the lower locking member 128 and/or the upper locking member 346 may be stored in the retainer 158 when not in use.

In an aspect of the illustrated embodiment, the carriage plate 116, the bracket 126, and the locking plate 142 are retrofittable to an existing pallet fork by a cost effective method including welding, brazing or riveting, or any other practical means.

As should be understood, the present disclosure provides a pallet fork having tines that can be locked in a lateral position on the fork carriage assembly. The carriage assembly has a fixed slotted plate. One or more locking members capture the fork tine using the fixed slotted plate and thereby prevents lateral/horizontal movement of the fork tines. However, embodiments described herein still allow the fork tines to swing freely about the fork bar an angle θ. Accordingly, the present disclosure provides a simple locking device for tine lateral movement, which do not require tools for adjustment. This also provides optimized visibility for an operator the locking plates are not in sight lines for an operator viewing the tines from an operator station.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A pallet fork comprising:

a frame, the frame including a top support tube, and a bottom support tube between opposing end plates;

a fork bar and a carriage plate supported by the frame and extending in a longitudinal direction of the pallet fork;

a fork tine mounted to the fork bar via a slotted tube, the fork tine having a pivotable motion and a lateral motion relative thereto, the fork tine including a vertical leg and a horizontal leg, wherein the slotted tube is at an upper portion of the vertical leg;

a locking plate having a plurality of notches provided on the top support tube; and an upper locking member configured to be selectively inserted through a slot in the slotted tube and through one of the plurality of notches to engage the vertical leg of the fork tine with the locking plate and restrict the lateral motion of the fork tine, the upper locking member having a head portion with an open point that rests on a top surface of the top support tube, the slotted tube is disposed between the vertical leg of the fork tine and the head portion of the upper locking member.

2. The pallet fork of claim 1, wherein the upper locking member is formed generally having a question mark shape.

3. The pallet fork of claim 1, wherein the upper locking member has a shaft portion configured to pass through the slot in the slotted tube with a single orientation direction.

4. The pallet fork of claim 1, wherein the pivotable motion is restricted to a range of approximately 0° to approximately 75° by a rear shoulder portion of the upper locking member contacting an end of the slot in the slotted tube.

5. The pallet fork of claim 1, wherein the slot in the slotted tube extends a distance of approximately one-half way through the slotted tube.

6. The pallet fork of claim 1, further including a locking pin configured to be selectively inserted in the upper locking member to hold the upper locking member in one of the plurality of notches.

7. The pallet fork of claim 1, further including, a first set of ribs extending between the top support tube and the bottom support tube, the first set of ribs being oriented with an inward slant towards a rear portion of the of pallet fork.

8. The pallet fork of claim 7, further including a second set of ribs extending between the top support tube and the bottom support tube, the second set of ribs being oriented with an outward slant towards the rear portion of the pallet fork.

9. The pallet fork of claim 7, further including a second locking pin configured to be selectively inserted in the lower locking member to hold the lower locking member in the bracket.

10. The pallet fork of claim 1, further including a bracket attached to the vertical leg of the fork tine, and a lower locking member configured to be selectively inserted in the bracket to engage the fork tine with the carriage plate and restrict the swingable motion of the fork tine.

11. The pallet fork of claim 1, further including a retainer mounted on one of the end plates to store the lower locking member and the upper locking member.

12. The pallet fork of claim 1 further including one or more mounting brackets on the frame, the one or more mounting brackets configured to removably mate with a machine.

13. A removable pallet fork comprising:

a frame, the frame including a top support tube, and a bottom support tube between opposing end plates;

a fork bar and a carriage plate supported by the frame and extending in a longitudinal direction of the pallet fork;

a fork tine mounted to the fork bar via a slotted tube, the fork tine having a pivotable motion and a lateral motion relative thereto, the fork tine including a vertical leg and a horizontal leg, wherein the slotted tube is welded to an upper portion of the vertical leg;

a locking plate on the top support tube having a notch;

an upper locking member configured to be selectively inserted through a slot in the slotted tube and through the notch to engage the vertical leg of the fork tine with the locking plate and restrict the lateral motion of the fork tine, the upper locking member having a head portion with an open point that rests on a top surface of the top support tube, the upper locking member also having a shoulder, the pivotable motion being limited by the shoulder contacting an end point of the slot, the slotted tube is disposed between the vertical leg of the fork tine and the head portion of the upper locking member;

a first set of ribs extending between the top support tube and the bottom support tube, the first set of ribs being oriented with an inward slant towards a rear portion of the of pallet fork;

a second set of ribs extending between the top support tube and the bottom support tube and inward of the first set of ribs, the second set of ribs being oriented substantially normal to a longitudinal direction of the removable pallet fork; and one or more mounting brackets on the frame, the one or more mounting brackets configured to removably mate with a machine, wherein the top support tube is disposed above a top of the vertical leg of the fork tine.

14. The removable pallet fork of claim 13, wherein the upper locking member is formed generally having a question mark shape.

15. The removable pallet fork of claim 14, wherein the upper locking member is formed of ASTM-572 steel.

16. The removable pallet fork of claim 13, wherein the upper locking member has a shaft portion configured to pass through the slot in the slotted tube with a single orientation direction.

17. The removable pallet fork of claim 13, wherein the slot in the slotted tube extends a distance of approximately one-half way through the slotted tube, whereby the pivotable motion is restricted to a range of approximately 0° to approximately 75°.

18. The removable pallet fork of claim 13, further including a locking pin configured to be selectively inserted in the upper locking member to hold the upper locking member in the notch.

19. The removable pallet fork of claim 13, further including a bracket attached to a rear portion of the vertical leg of the fork tine, and a lower locking member configured to be selectively inserted in the bracket to engage the fork tine with the carriage plate, the removable pallet fork further including a second locking pin configured to be selectively inserted in the lower locking member to hold the lower locking member in the bracket.

20. The removable pallet fork of claim 13, further including a retainer mounted on one of the end plates to store the lower locking member and the upper locking member.

* * * * *